US005708441A

United States Patent [19]

Kanai

[11] Patent Number: 5,708,441

[45] Date of Patent: Jan. 13, 1998

[54] ANTENNA DIRECTIVITY CONTROL METHOD AND CHANNEL CONFIGURATION METHOD FOR A MOBILE COMMUNICATION SYSTEM

[75] Inventor: Toshihito Kanai, Tokyo, Japan

[73] Assignee: NEC Corporation, Japan

[21] Appl. No.: 660,161

[22] Filed: Jun. 3, 1996

[30] Foreign Application Priority Data

Jun. 5, 1995 [JP] Japan ..... 7-138201

[51] Int. Cl.[6] ..... H01Q 3/00

[52] U.S. Cl. ..... 342/359; 342/372

[58] Field of Search ..... 342/359, 428, 342/372

[56] References Cited

U.S. PATENT DOCUMENTS 3,950,753 4/1976 Chisholm .

4,352,202 9/1982 Carney .

5,227,806 7/1993 Eguchi ..... 342/359

5,300,935 4/1994 Yu ..... 342/359

5,329,522 7/1994 Takagi ..... 342/359

*Primary Examiner*—Theodore M. Blum

*Attorney, Agent, or Firm*—Ostrolenk, Faber, Gerb & Soffen, LLP

[57] ABSTRACT

A control method of the direction of directivity of a base station antenna in a mobile communication system which uses a variable directivity antenna at the base station. The direction of directivity is controlled to continuously change such that signal reception level at each mobile station exceeds a prescribed value during the time interval from the beginning of the first slot to the end of the (n+1)th slot of any continuous n+1 (n being a natural number) slots on at least one time-division-multiplexed channel.

9 Claims, 10 Drawing Sheets

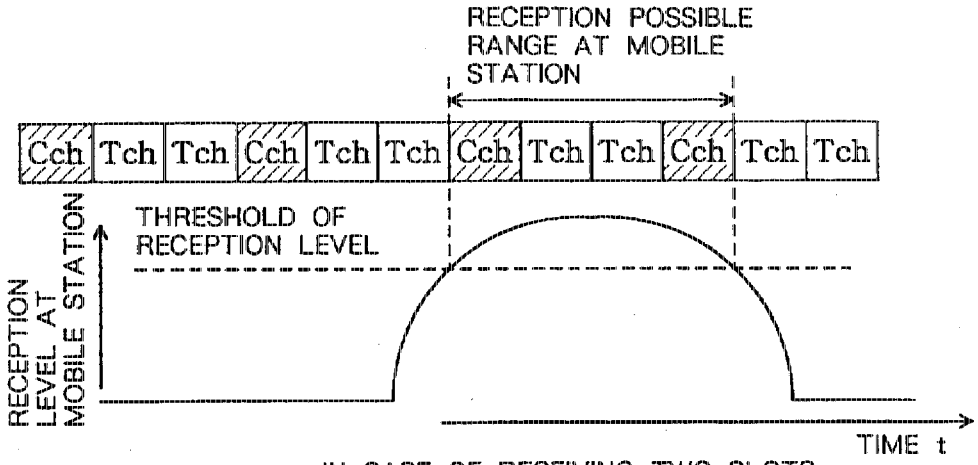
FIG. 4A IN CASE OF RECEIVING TWO SLOTS OF CONTROL CHANNEL
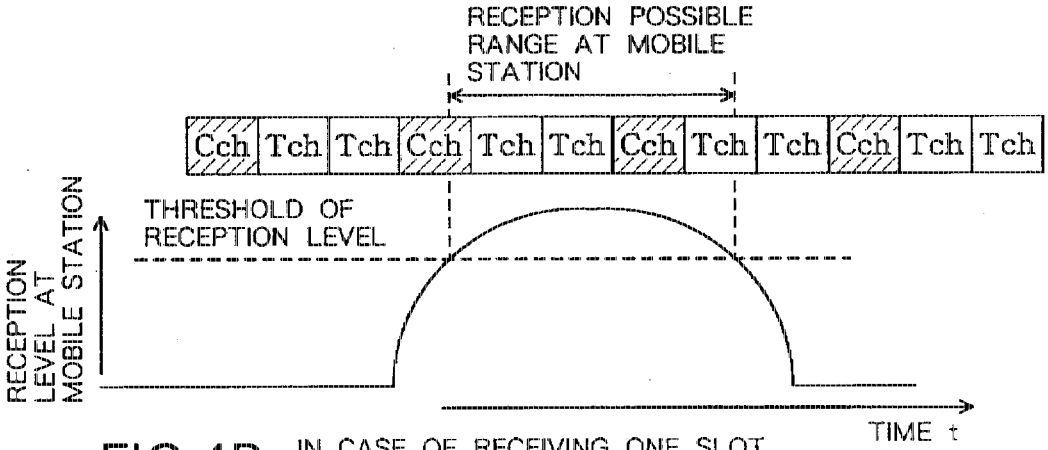
FIG.4B IN CASE OF RECEIVING ONE SLOT OF CONTROL CHANNEL
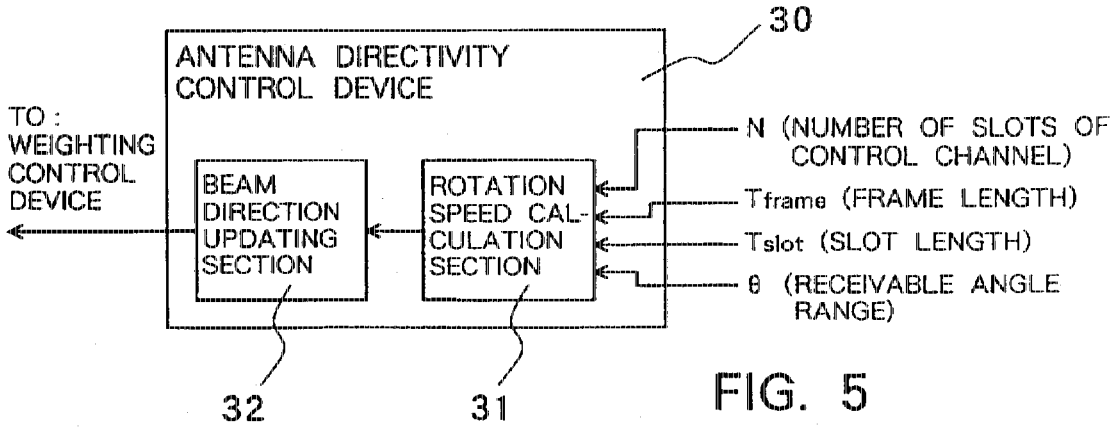
FIG. 5

ANTENNA DIRECTIVITY CONTROL METHOD AND CHANNEL CONFIGURATION METHOD FOR A MOBILE COMMUNICATION SYSTEM

BACKGROUND OF THE INVENTION

1. Field of the Invention:

The present invention relates to a cellular mobile communication system, and particularly to a directivity control method for a control-channel antenna and a control channel configuration method in a mobile communication system having extended communication range between a base station and mobile stations through the use of a base station antenna having high gain and variable directivity.

2. Description of the Related Art:

Mobile communication systems such as car-phone systems and portable telephone systems offer communication service to multiple mobile stations scattered over a wide area by distributing a plurality of base Stations. A system that provides mobile communication by dividing a service area into small zones in this way is called a cellular system.

In addition to the propagation characteristics of radiowaves of the employed frequency band, the communication range between a base station and a mobile station depends on such radio transmission technological factors as the radio transmission power, antenna gain, and the modulation/demodulation method. Generally speaking, greater communication range means that fewer base stations are required to cover the same area and enables the construction of a more economical system.

Factors such as communication available time or the effect of electromagnetic waves on the environment impose limits on the extent to which the radio transmission power can be increased on the mobile station side (particularly for portable terminals). As a result, communication range is generally extended by increasing the antenna gain on the base station side. To the extent that antenna gain is increased, however, the directivity characteristic of the antenna becomes more critical and the beam width narrower. Therefore, an increase in antenna gain also increases the number of antennas required to provide service in all directions from the base station. Base stations of current car-phone systems are generally of a construction employing three or six directional antennas having a half power width (the angle between the directions at which gain falls 3 dB from maximum gain) on the order of 30° to 90°. Such constructions are termed a three-sector configuration or six-sector configuration.

Apart from a sector configuration, methods which employ directional high-gain antennas while limiting the increase in the number of antennas are disclosed in Japanese Patent Laid-open Application No. Sho 59-152739 (JP, A, 59-152739), which is titled as "Method for Automatically Setting Antenna Direction of Radio Base Station", and Japanese Patent Laid-open Application No. Hei 3-76439 (JP, A, 3-76439), which is titled as "Mobile Communication System". In the method disclosed in JP, A, 59-152739, a base station is provided with a nondirectional antenna and a directional antenna mounted on a rotating antenna base. When communication is initiated, a location designation signal (i.e., a connection request signal) is sent from the mobile station side, this location designation signal is received by the nondirectional antenna, the bearing of the directional antenna is automatically shifted in the direction of the mobile station designated by the location designation signal, and subsequent communication is carried out using the directional antenna. In the method disclosed in JP, A, 3-76439, a directional antenna provided at a base station is rotated in advance, rotation of the antenna is halted at the time a connection request signal is received from a mobile station, and communication carried out. In both of the methods disclosed in these publications, the directional antenna of the base station is directed toward the mobile station only when communication is necessary, and there is no necessity for an antenna capable of covering all directions simultaneously.

In the method disclosed in JP, A, 59-152739, the location designation signal sent from a mobile station at the initiation of communication is received by a nondirectional base station antenna, and the communication range is therefore limited by this nondirectional antenna. Accordingly, the transmission power during communication can be reduced by using a directional antenna, but a significant extension of the service area cannot be expected. On the other hand, in the method described in JP, A, 3-76439, a connection request signal from a mobile station is received by a directional antenna, and a larger service area can therefore be achieved because the transmission range is determined by the directional antenna.

As for methods in which the direction of the directivity of an antenna is rotated, in addition to methods in which an antenna of high directivity is mechanically rotated, there also exist electrical methods which employ an antenna composed of a plurality of elements and in which the phase difference of transmission power supplied to each element is changed or the distribution ratio to each element is changed. In this specification, the principle of rotating an antenna of high directivity includes, in addition to the mechanical rotation of an antenna, the rotation of the direction of maximum synthesized directivity by changing the distribution ratio or phase difference of the power supplied to antenna elements.

However, rotating a base station antenna of high directivity may complicate transmission and reception of control signals on the control channel. This problem is further explained hereinbelow.

FIG. 1A shows one example of the directivity pattern of a base station antenna. In this example, the direction of antenna directivity pattern 92 (the beam direction) rotates in a counterclockwise direction over time with base station 91 as the center. FIGS. 1B and 1C are graphs showing the change in received level over time in a case in which mobile stations receive signals from a rotating base station antenna, FIG. 1B showing a case in which the rotation speed is high, and FIG. 1C showing a case in which the speed of rotation is low. Because the antenna of high directivity is rotating, the mobile station side can receive signals of sufficient intensity only over a limited time period. As shown in the figures, the width of this time period during which reception is possible depends on the rotation speed, the time period decreasing with higher rotation speeds.

FIGS. 2A and 2B show the relation between the timing of signal reception level at a mobile station and forward control channel signals. Forward channel is a channel in the direction from base station to mobile station. This case assumes the use of three-channel TDMA (Time Division Multiple Access) as the channel multiplexing system, one of these channels being assigned as the control channel (C-ch) and the other two being assigned as communication channels (T-ch). In the example shown in FIG. 2A, the control channel is received during the time that the reception level exceeds the threshold value, and correct control information therefore can be obtained. In the example shown in FIG. 2B, however, only a portion of the control channel can be received during the time that the reception level exceeds the threshold value, and correct control information cannot be obtained. If information that could not be received is the call signal to that mobile station, transmission of correct termination to the mobile station cannot be achieved. If the state shown in FIG. 2A occurs only sporadically and the state shown in FIG. 2B dominates, transmission and reception of control signals will be extremely unreliable.

The forward control channel is generally configured such that a plurality of slots for mutually differing functions such as a notification (broadcasting) channel (BCCH), an individual cell signaling channel (SCCH), and a simultaneous paging channel (PCH) are arranged to repeat periodically. For correct operation of the system, the reception of all of these types of control channels on the mobile station side must be guaranteed.

Thus, in a case in which a base station antenna of high directivity is rotated, the problem arises that transmission and reception of control signals on control channels is complicated by excessively high rotation speeds. No solutions to this problem is provided by JP, A, 3-76439.

While the simplest solution to this problem is to make the rotation speed of the directional antenna sufficiently low, mere reduction of the rotation speed in turn creates new problems by lengthening the time required for one revolution of the direction of the directional center, increasing the time required for call connection, and reducing the service capabilities of the system. Here, the case of the forward control channel has been explained by way of example, but the same problems arise for the reverse control channel. Reverse channel is a channel in the direction from mobile station to base station.

SUMMARY OF THE INVENTION

The first object of the present invention is to provide, in a mobile communication system that uses a base station antenna in which the center direction of directivity rotates, a control method of antenna directivity which can increase the reliability of transmission and reception of control signals without reducing service availability.

The second object of the present invention is to provide a channel configuration method appropriate to the above-described antenna directivity control method.

The first object of the present invention is achieved by an antenna directivity control method in a mobile communication system including a base station and mobile stations disposed within radio zones corresponding to the base station which perform radio communication with the base station, and using at the base station an antenna having variable direction of directivity; the method being a control method of the direction of directivity whereby the direction of directivity of the base station antenna is continuously changed such that signal reception level at each mobile station exceeds a prescribed value during a time interval from beginning of a first slot to end of an (n+1)th slot of any continuous n+1 (n being a natural number) slots on at least one time division multiplexed channel.

Here, it is preferable that the rotation speed of the direction of directivity of the base station antenna be set such that the time required for the direction of directivity to make one revolution is an integral power of the period of repetition of slots on one channel.

In addition, the first object of the present invention can be achieved by an antenna directivity control method in a mobile communication system including a base station and mobile stations disposed within radio zones corresponding to the base station which perform radio communication with the base station, and employing at the base station an antenna having variable direction of directivity within a horizontal plane; the method being a control method of the direction of directivity whereby the direction of directivity of the base station antenna is changed with n (n being a natural number) continuous slots on one time division multiplexed channel used as units.

The second object of the present invention is achieved by a channel configuration method of a mobile communication system applying the antenna directivity control method of the present invention in which a period of a channel received by a mobile station has a relatively prime relation with respect to a period of repetition of multiplexed slots having same function on the channel.

Regarding the principles of the present invention, first, in order to ensure the reliability of the transmission and reception of control signals, the control channel must without fail appear in any mobile station during the limited time period for which signals of sufficient intensity can be received at the mobile stations. While fulfilling this requirement, the rotation speed of the direction of directivity of the base station antenna must also be increased as much as possible to improve service availability.

In the present invention, for cases in which the direction of directivity of the base station antenna is continuously rotated, the rotation speed of the antenna directivity pattern is set such that the time during which the signal reception level exceeds the reception level threshold value at any mobile station within the zones (typically, the time during which reception level threshold value is exceeded at a mobile station within zone boundaries) is equal to or longer than the time interval from the beginning of the first slot to the end of the (n+1)th slot for the n+1 continuous slots on the control channel. In this way, for any mobile station, n control channel slots can be transmitted and received without fail in the time during which the signal reception level exceeds the threshold value at that mobile station. Here, if the time required for one revolution of the direction of directivity of the base station antenna is made an integral multiple of the period of repetition of slots on one channel, a control channel slot can be transmitted and received at the same period at the mobile station.

If the direction of directivity of the base station antenna is rotated in a stepwise manner, the n continuous slots on the control channel are transmitted and received in the intervals during which the direction of antenna directivity is fixed within the stepped movement. In this way, for any mobile station, n control-channel slots can be transmitted and received without fail during the time the signal reception level exceeds the threshold value at that mobile station.

According to the channel configuration method of the present invention, in a mobile communication system applying the above-described antenna directivity control method, the control channel is configured such that the period of repetition of multiplexed slots having identical functions on the control channel have a relatively prime relation to the period of control channel slots received by a mobile station, thereby enabling a mobile station to receive all of the function slots multiplexed on the control channel.

The above and other objects, features, and advantages of the present invention will become apparent from the following description based on the accompanying drawings which illustrate an example of a preferred embodiment of the present invention.

BRIEF DESCRIPTION OF THE DRAWINGS

FIGS. 4A and 4B illustrate examples of the timing relation between signal reception level and forward control channel at a mobile station in the system of FIG. 3;

FIG. 5 is a block diagram showing one example of the construction of an antenna directivity control device;

DETAILED DESCRIPTION OF THE PREFERRED EMBODIMENTS

Figure 1A:
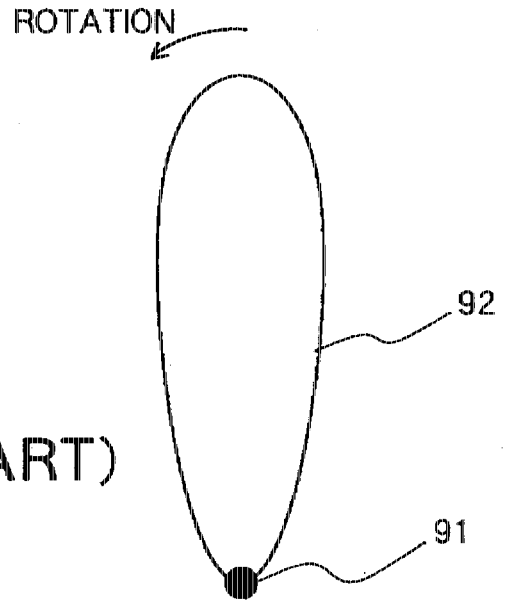
FIG. 1A (PRIOR ART)
FIG. 1A illustrates the rotation of the directivity pattern of a base station antenna.
Figure 1B:
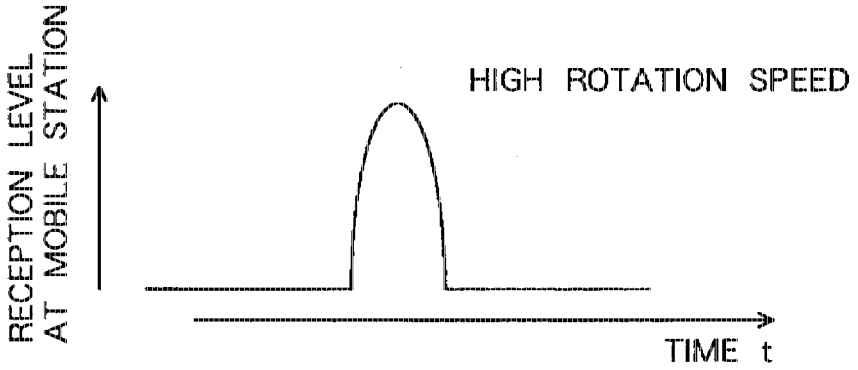
FIG. 1B (PRIOR ART)
FIG. 1B illustrates the change in signal reception level at a mobile station for a case in which the rotation speed of the directivity pattern of a base station antenna is high.
Figure 1C:
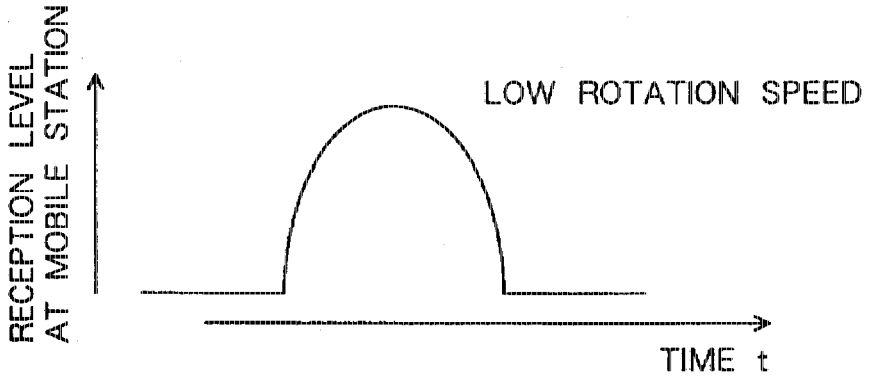
FIG. 1C (PRIOR ART)
FIG. 1C illustrates the change for a case in which the rotation speed is low.
Figure 2A:
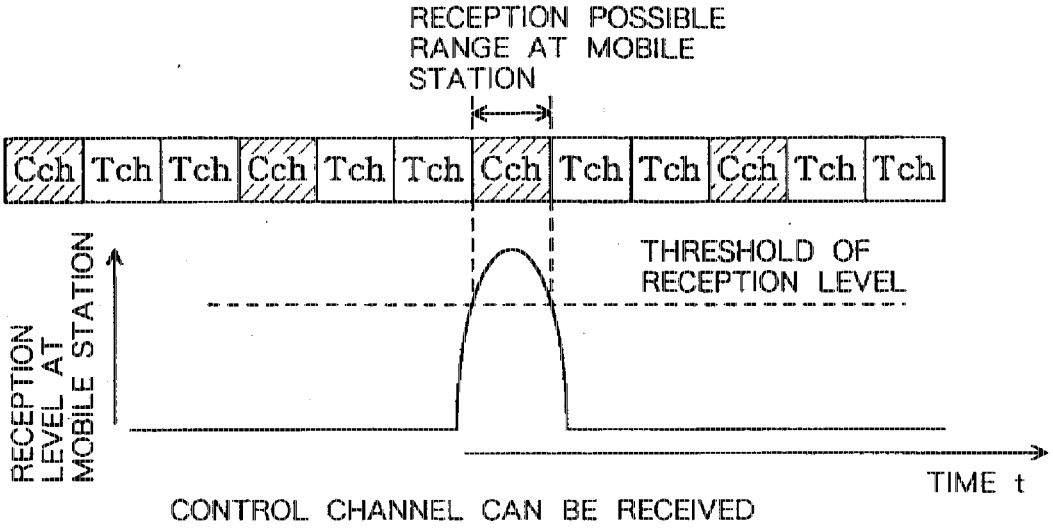
FIG. 2A (PRIOR ART)
FIGS. 2A and 2B show the timing relation between signal reception level and a forward control channel at a mobile station.
Figure 2B:
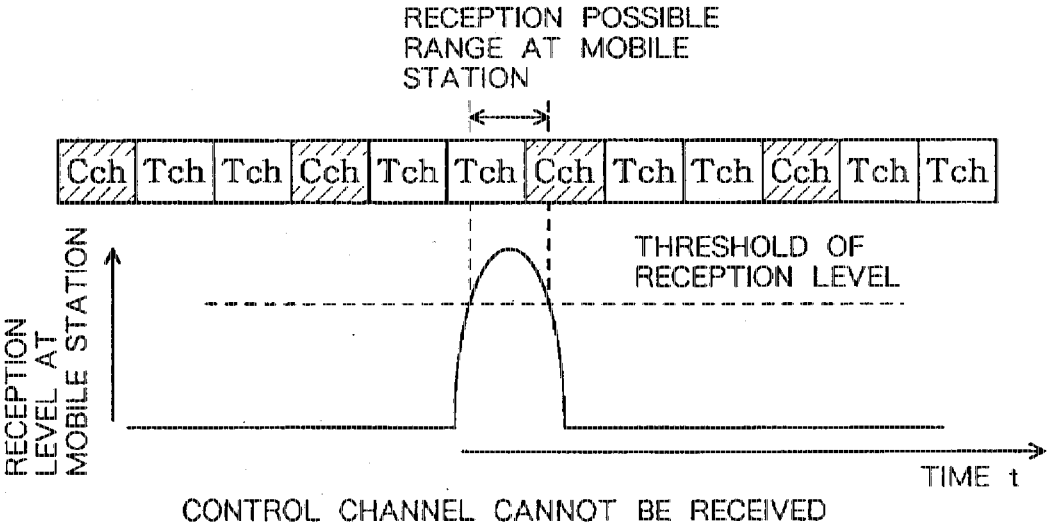
FIG. 2B (PRIOR ART)
Figure 3:
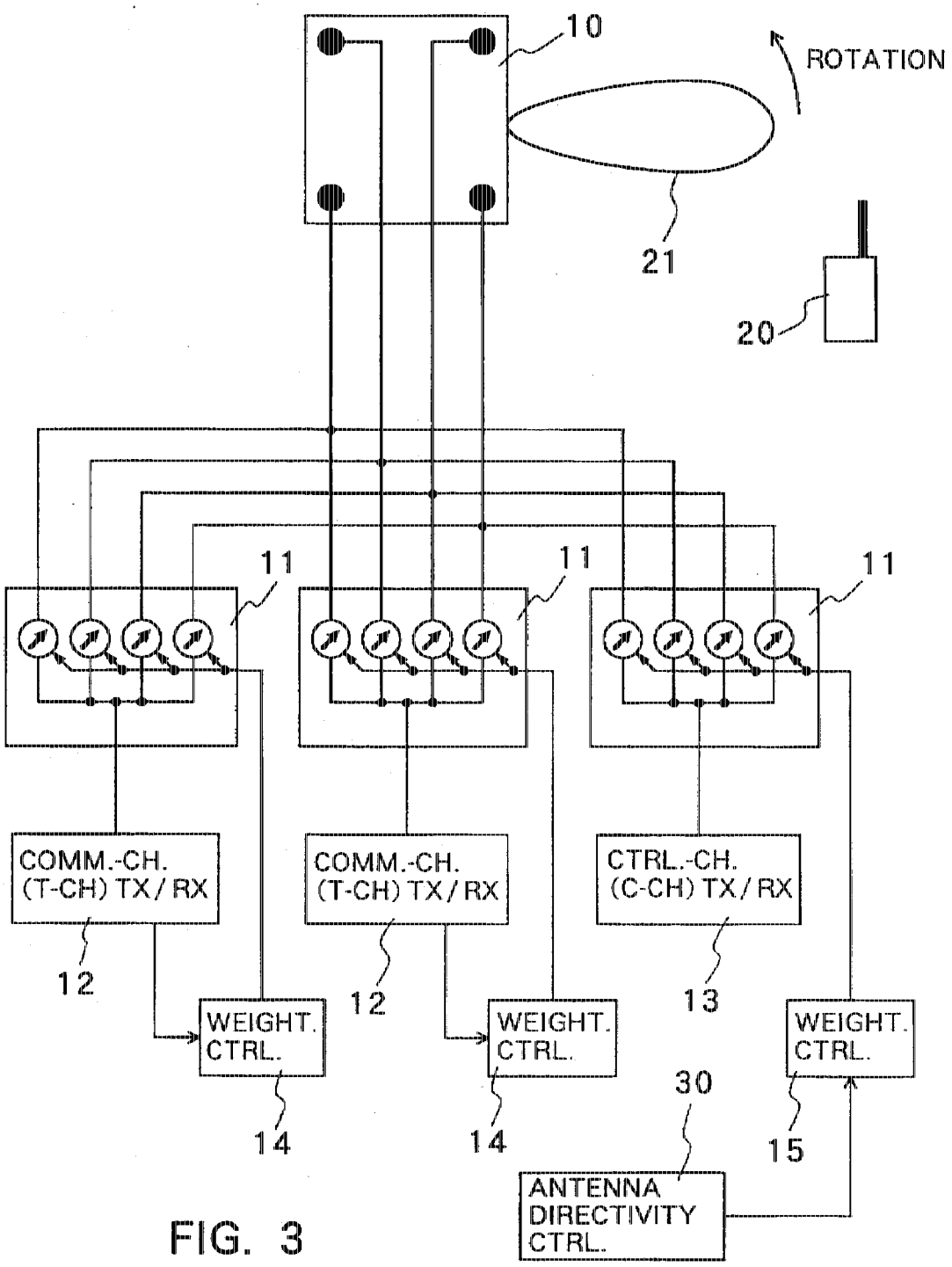
FIG. 3 is a block diagram showing the basic construction of a base station having a variable directivity antenna in which the antenna directivity control method and channel configuration method are realized according to a preferable embodiment of the present invention.

A base station according to the basic construction shown in FIG. 3 has a variable-directivity antenna, carries out communication with mobile station 20, and applies the antenna directivity control method for control channel use and the control channel configuration method according to preferable embodiments of the present invention.

This base station is provided with antenna 10 composed of four elements, two communication-channel radio transmitter/receivers 12, and one control-channel radio transmitter/receiver 13. In addition, weighting circuits 11 for enabling variable setting of the directivity of antenna 10 by changing the weighting for each element of antenna 10 are provided for each radio transmitter/receiver 12, 13. The outputs of these three weighting circuits 11 are combined for each element of antenna 10 and connected to each element. As a result, variable setting of antenna directivity is enabled for each communication channel and control channel.

Communication-channel weighting control devices 14 that calculate the optimum weighting coefficient for maximizing the carrier-to-interference ratio (hereinafter abbreviated CIR) sent from mobile station 20 are connected to and output to weighting circuits 11 corresponding to communication-channel radio transmitter/receivers 12. Similarly, control-channel weighting control device 15 that calculates the weighting coefficient to change the direction of the control-channel directivity pattern is connected to the weighting circuit 11 corresponding to control-channel radio transmitter/receiver 13 and outputs to this weighting circuit 11. Control-channel weighting control device 15 is in turn connected to antenna directivity control circuit 30 which indicates the beam direction of the control channel to this weighting control device 15. In this case, explanation will be given for a device in which the directivity pattern of base station antenna 10 is electrically rotated, but the directivity pattern may also be rotated by mechanically rotating the antenna as described in the above-described JP, A, 59-152739 or JP, A, 3-76439. In FIG. 3, reference numeral 21 indicates an instantaneous directivity pattern.

Usual methods are used for finding the optimum weighting for maximizing the CIR for each mobile station at communication-channel weighting control device 14, as well as for finding the weighting in control-channel weighting control device 15 for directing the directivity pattern in a designated beam direction. For details regarding such methods, reference may be make to, for example, IEEE Transactions Antennas and Propagation, Special Issue on Adaptive Processing Antennas Systems, Vol. AP-34, No. 3, March 1986.

FIGS. 4A and 4B illustrate the timing relation between signal reception level and the forward control channel at mobile station 20 of the present embodiment. Here, the directivity pattern of base station antenna 10 is continuously rotated, and the speed of this rotation is set such that the time interval from the head of the first slot to the end of the second slot of the two continuous slots on the control channel is equal to the time that the signal reception level exceeds the threshold value at the mobile station under the worst conditions. In this case, a mobile station under the worst conditions refers to the mobile station that, due to such reasons as location at a zone boundary, experiences the lowest signal receiving level of the mobile stations within a zone. In addition, the threshold value is a value set to the signal reception level as a standard for allowing proper signal reception. Finally, a number of slots belonging to the communication channel are generally present between the continuous slots on the control channel.

In this way, as shown in FIG. 4A, at a particular mobile station, reception of a control channel slot begins at the same time the signal reception level exceeds the threshold value, and reception of the next slot of the control channel ends at the same time the signal reception level falls below the threshold value. Accordingly, at this mobile station, the two continuous slots on the control channel can be received. This matching of the timing of the control channel and the timing of rotation of the base station antenna is extremely rare, and the two timings are shifted as shown in FIG. 4B in nearly all cases. Nevertheless, even if the timing of the control channel is shifted in either direction, one control channel slot can be received without fail. FIGS. 4A and 4B illustrate a base station antenna rotation speed for enabling reception of at least one control channel slot at any mobile station, but for reliably receiving n continuous control channel slots, the base station antenna directivity should obviously be rotated such that the time interval from the start of the first slot to the end of the (n+1)th slot of n+1 continuous slots is equal to the time that the signal reception level of the mobile station under worst conditions exceeds a threshold value.

FIG. 5 shows the construction of a control-channel antenna directivity control device 30 used for rotating the direction of directivity pattern about a horizontal area in this way. This antenna directivity control device 30 is provided with rotation speed calculation section 31 and beam direction updating section 32. The input of antenna directivity control device 30 include: the period of repetition of control channel slot (referred to as "frame length" in the figure) $T_{frame}$, the slot length $T_{slot}$, the number N of control channel slots to be continuously received, and the antenna rotation angle range θ for which signal reception level is greater than the threshold value for a mobile station at a zone boundary, i.e., under worst conditions. These data are inputted to the rotation speed calculation section 31, and the rotation speed calculation section 31 finds the rotation speed ω of the directional antenna for control channel use by the calculation formula:

$$\omega=\theta/(T_{frame}\times N+T_{slot}) \quad (1)$$

Rotation speed calculation section 31 passes this value ω on to beam direction updating section 32, and, if the time interval for updating beam direction is Δt, beam direction updating section 32 rotates beam direction ωΔt for every updating time and outputs this instruction to weighting control device 15. Updating time interval Δt is a minute amount, and the beam direction therefore appears to change continuously.

Use of this antenna directivity control device 30 ensures that all mobile stations within a zone will reliably transmit and receive n control channel slots during the interval that signal reception level at that mobile station exceeds the threshold value.

Figure 6A:
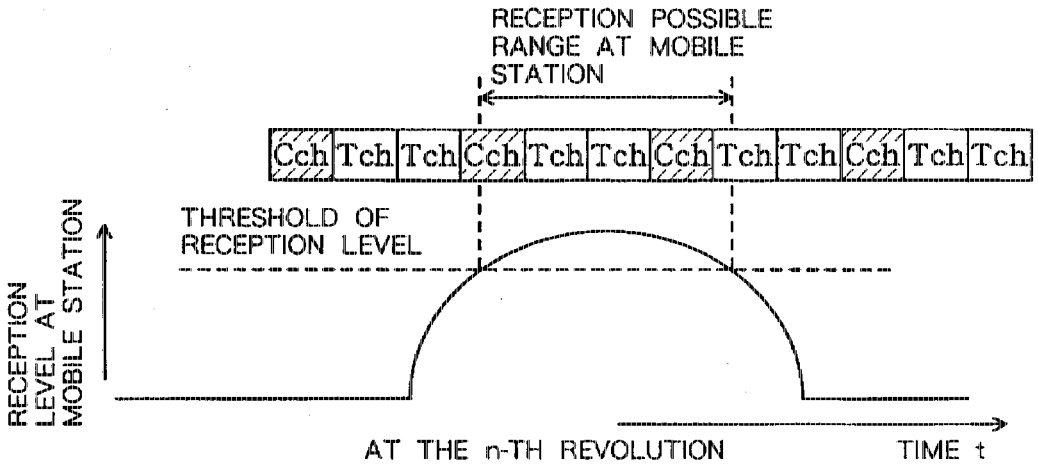
FIGS. 6A, 6B, and 6C show examples of the timing relation between signal reception level and forward control channel at a mobile station at the n-th, (n+1)th, and (n+3)th revolutions, respectively, of the antenna directivity pattern.
Figure 6B:
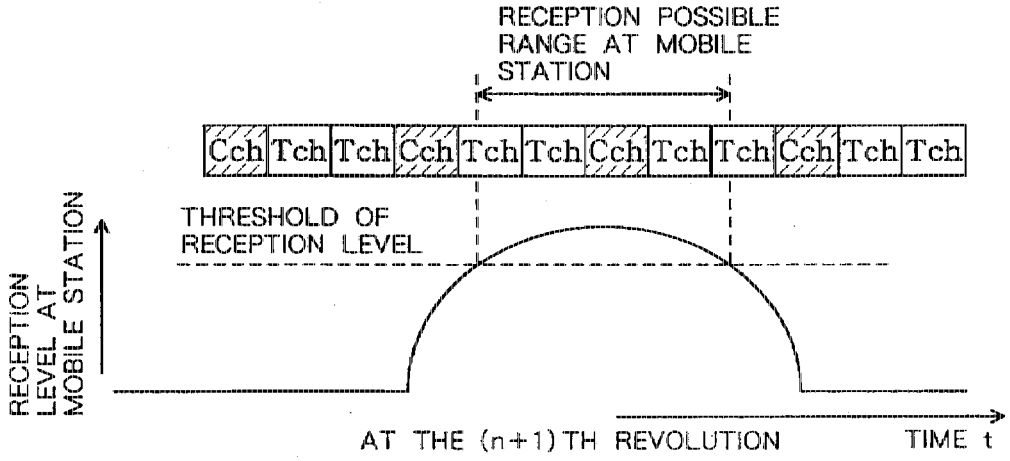
Figure 6C:
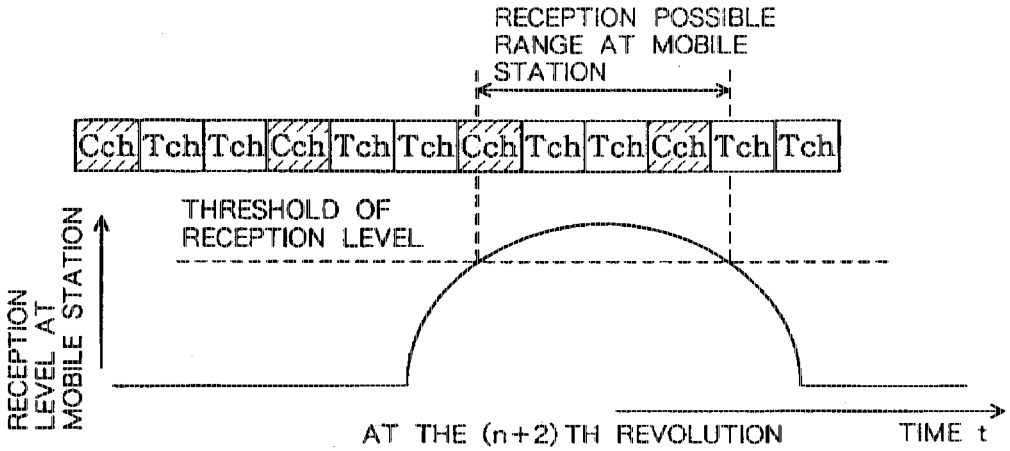

The period of the control channel slots received by the mobile stations will next be considered. FIGS. 6A, 6B, and 6C illustrate the relative timing of the signal reception level and forward control channel at a mobile station at the n-th, (n+1)th, and (n+3)th revolutions, respectively, in the rotation of directivity pattern, i.e., beam direction, of base station antenna 10. It will here be assumed that the base station transmits 3M+1 (M being a natural number) slots in the time that the base station antenna directivity pattern makes one revolution. It will also be assumed that two communication channel slots (T-ch) are present between two continuous control channel slots (C-ch).

As can be seen by comparing FIGS. 6A and 6B, the timing at which the mobile station receives the (n+1)th control channel precedes the n-th revolution by the width of one slot. Although not shown in the figure, the timing at which the mobile station receives the (n+2)th control channel should also precede the n-th revolution by the width of two slots. However, at the (n+3)th revolution, since the control channel which is advanced by the width of three slots straddles the boundary of the receivable range of the mobile station, the mobile station is unable to receive the control channel slot at a timing that precedes the n-th revolution by a width of three slots and receives at the same timing as for the n-th revolution. As a result, while the interval of received control channel slots is 3M between the n-th revolution and the (n+1)th revolution, and between the (n+1)th revolution and the (n+2)th revolution, the interval of received control channel slots between the (n+2)th revolution and the (n+3)th revolution is 3M+3, an interval that extends longer than the other cases.

When the period of receivable control channel slots varies in this way, control is complicated because the intermittent reception interval of a mobile station in a call-waiting state must be matched to this varying period. To circumvent this problem, the base station can transmit 3M (M being a natural number) slots in the time of one revolution of the base station antenna directivity. If the time required for the base station directivity to make one revolution is set to an integral multiple of the period of repetition of slots on the control channel, the mobile station can always receive control channel slots at the same timing. If the period of repetition of control channel slots is $T_{frame}$, the slot length is $T_{slot}$, the number of control channel slots to be continuously received at the mobile station is N, and the rotation angle of the antenna beam direction such that the signal reception level at a mobile station on a zone boundary is greater than the threshold value is θ, the rotation speed ω of the directional antenna can be found from formula (1):

$$\omega=\theta/(T_{frame}\times N+T_{slot})$$

The time T required for one revolution is given by:

$$T=360°/\omega=360°\ (T_{frame}\times N+T_{slot})/\theta \quad (2)$$

Because this time T may be M times the period of repetition of slots on the control channel, the constraint becomes:

$$360°\ (T_{frame}\times N+T_{slot})/\theta=T_{frame}\times M \quad (3)$$

Solving this formula for rotation angle θ of the antenna beam direction gives:

$$\theta=360°\ (T_{frame}\times N+T_{slot})/(M\times T_{frame}) \quad (4)$$

The rotation angle can therefore be determined in this way.

Figure 7:
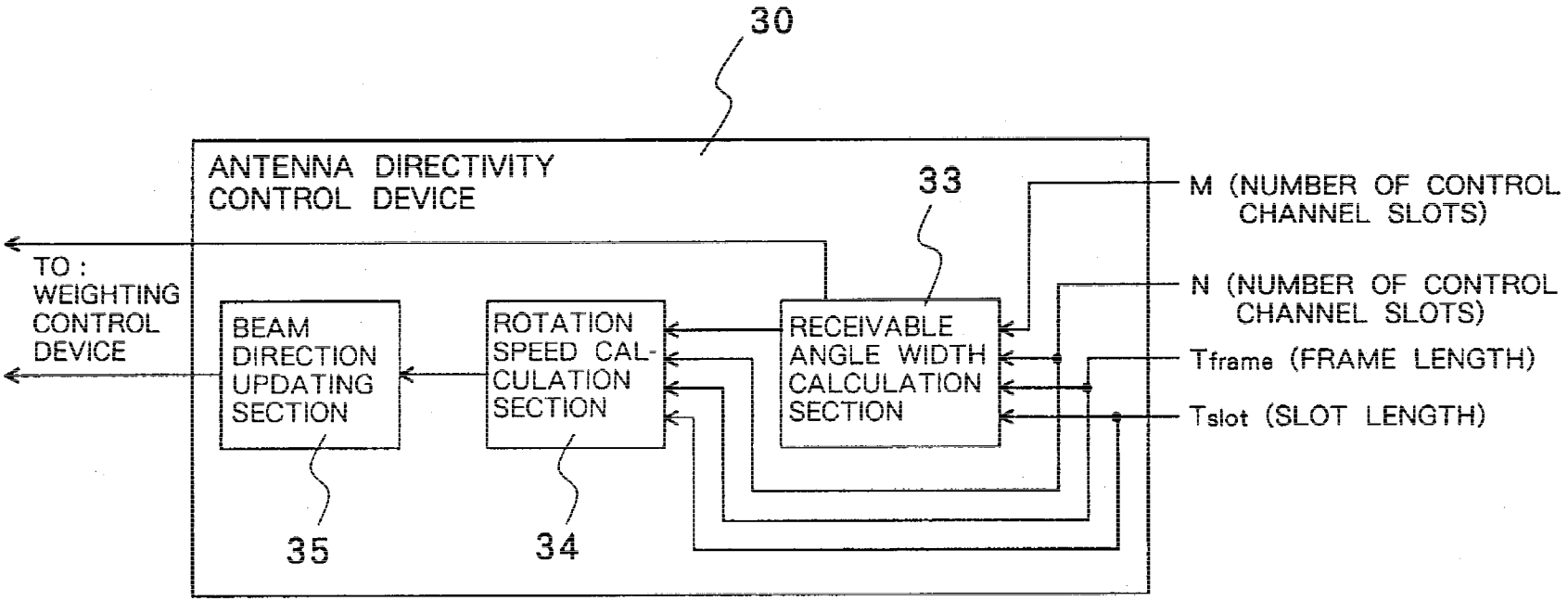
FIG. 7 is a block diagram showing another example of the construction of an antenna directivity control device.

FIG. 7 is a block diagram showing the construction of antenna directivity control device 30 used for rotating the directivity pattern at such a rotation angle θ. This antenna directivity control device 30 is provided with receivable angle width calculation section 33, rotation speed calculation section 34, and beam direction updating section 35. The input to antenna directivity control device 30 includes: the number M (frame number) of control channel slots transmitted in the time the directivity pattern of the base station antenna makes one revolution, the period of repetition of control channel slots (referred to as "frame length" in the figures) $T_{frame}$, the slot length $T_{slot}$, and the number N of control channel slots to be continuously received at a mobile station. These data are inputted to receivable angle width calculation section 33, and receivable angle width calculation section 33 finds the antenna rotation angle θ for which the signal reception level of a mobile station at a zone boundary is greater than the threshold value by the calculation formula:

$$\theta=360°\ (T_{frame}\times N+T_{slot})/(M\times T_{frame})$$

Receivable angle width calculation section 33 passes these data on to rotation speed calculation section 34 and weighting control device 15. In addition to the antenna rotation angle θ, frame length $T_{frame}$, slot length $T_{slot}$, and the number N of control channel slots to be continuously received at a mobile station are inputted to rotation speed calculation section 34. Rotation speed calculation section 34 then finds the rotation speed ω of the directional antenna for control channel use using calculation formula (1):

$$\omega=\theta/(T_{frame}\times N+T_{slot})$$

and inputs the result to beam direction updating section 32. Beam direction updating section 32, if Δt is the updating time interval for beam direction, rotates beam direction by ωΔt at every updating time and outputs to weighting control device 15. Weighting control device 15 calculates a weighting coefficient to realize the beam direction and antenna rotation angle θ designated at antenna directivity control device 30 and inputs to weighting circuit 11.

Although the foregoing explanation relates to a base station antenna having a continuously rotating directivity pattern, the present invention also allows stepped rotation and stepped change of the beam direction.

Figure 8A:
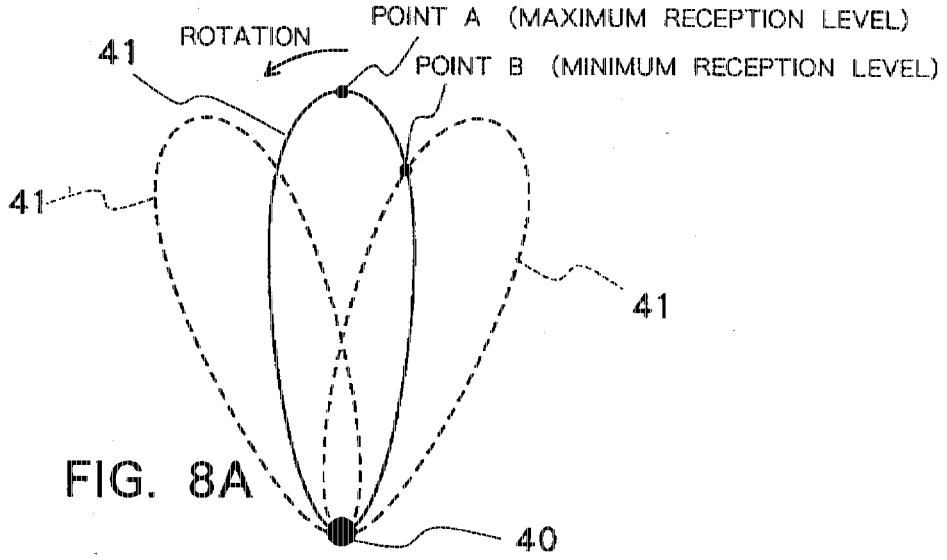
FIG. 8A illustrates stepwise rotation of the directivity pattern of the base station antenna.
Figure 8B:
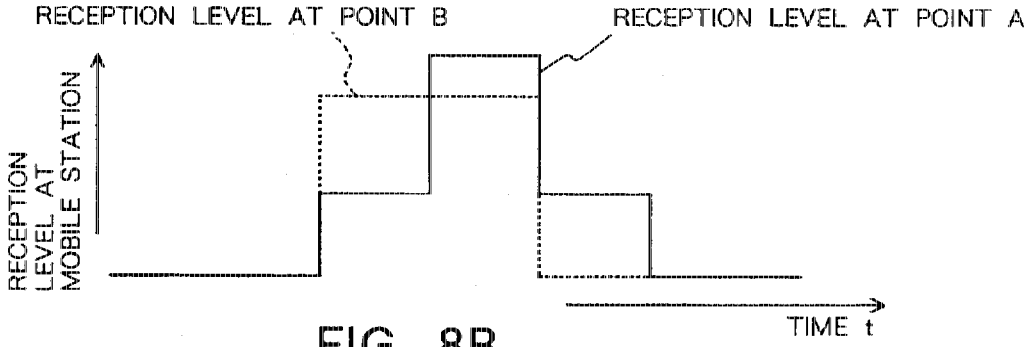
FIG. 8B illustrates changes in reception level at each mobile station as a result of stepwise rotation of the directivity pattern of a base station antenna.

In this case, beam directivity pattern 41 from base station 40 changes as shown in FIG. 8A. In addition, the rotation angle ϕ of one stepped change can be represented by ϕ=360°/L (L being a natural number), the beam direction making exactly one full revolution in L direction changes. In addition, the directivity pattern of the base station antenna is rotated such that the time from the beginning to the end of two continuous slots on the control channel equals the time the signal reception level exceeds the threshold value at the mobile station under worst conditions. The figure includes directivity patterns for three continuous steps and considers point A and point B as mobile station positions. Point A is at a position that lies on the beam axis at some time point in the stepped rotation, and point B lies at a position diverging from point A by 360°/2L as seen from the base station. In other words, point A is a position of maximum reception level, and point B is at a position of minimum reception level. FIG. 8B shows the change in reception level at point A and point B. Changing the beam direction in steps results in a difference in the manner of change in reception level according to the position of mobile stations. At point B in particular, even though the maximum reception level is lower than at other positions, the length of time a maximum value is recorded is double that of other positions because a signal of the same intensity is received from two adjacent directivity patterns.

Figure 9A:
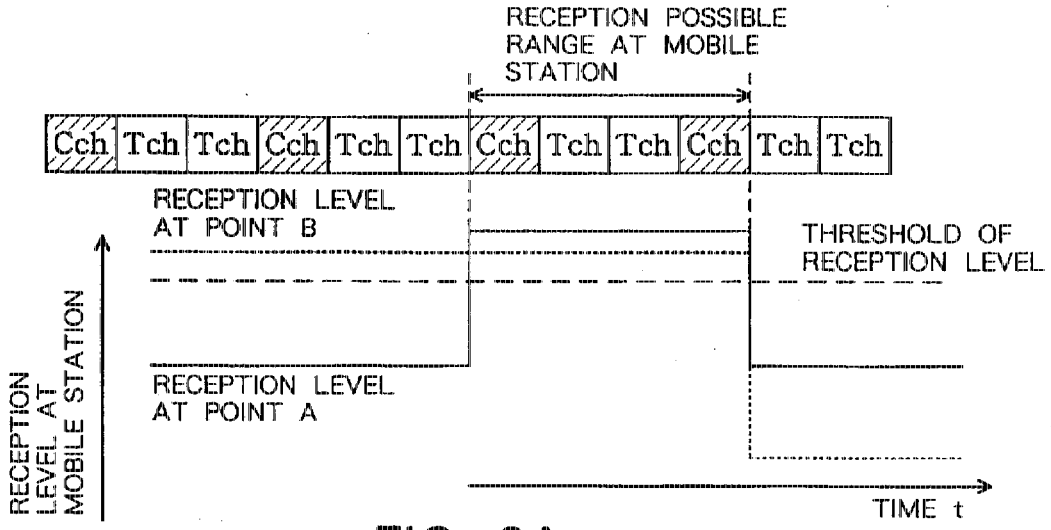
FIGS. 9A and 9B illustrate the timing relation between signal reception level and forward control channel at a mobile station for a case in which the directivity pattern of a base station antenna is changed in steps.
Figure 9B:
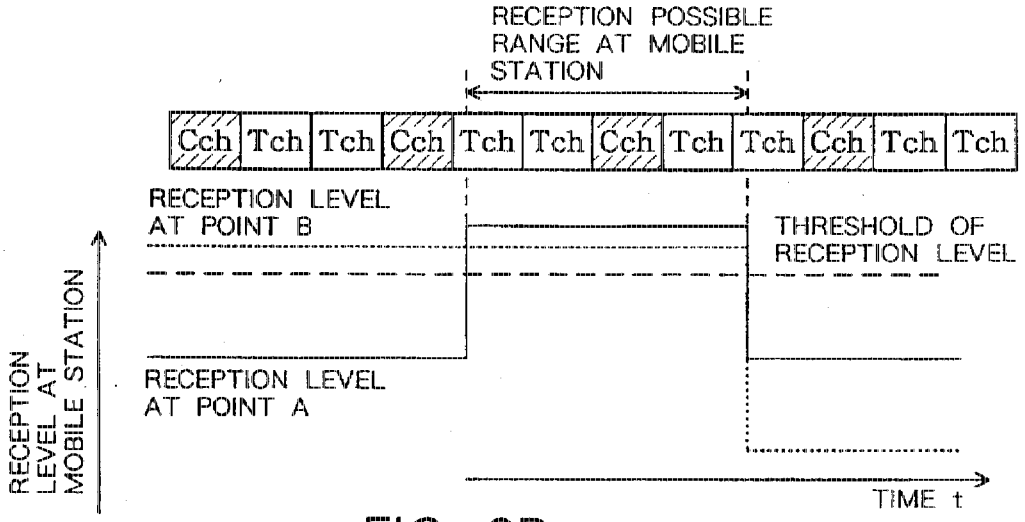

FIGS. 9A and 9B show the relative timing of the signal reception level and forward control channel at a mobile station for a case in which the directivity pattern of the base station is changed in steps. Here it is assumed that the rotation speed is set such that the reception level exceeds the threshold value only during the time interval in which the reception level at point A is a maximum. Accordingly, as shown in FIG. 9A, reception of a control channel slot begins at the same time the signal reception level exceeds the threshold value, and reception of the next slot on the control channel ends at the same time signal reception level falls below the threshold value. As a result, two continuous slots on the control channel can be received in this case. If control channel timing and base station antenna rotation timing are each set separately and correlation is not maintained between the two timings, matching of the two timings will be extremely rare and in nearly all cases, the two timings will diverge as shown in FIG. 9B. Nevertheless, regardless of the direction of divergence of the control channel timing, reception of one control channel slot is guaranteed.

Figure 10:
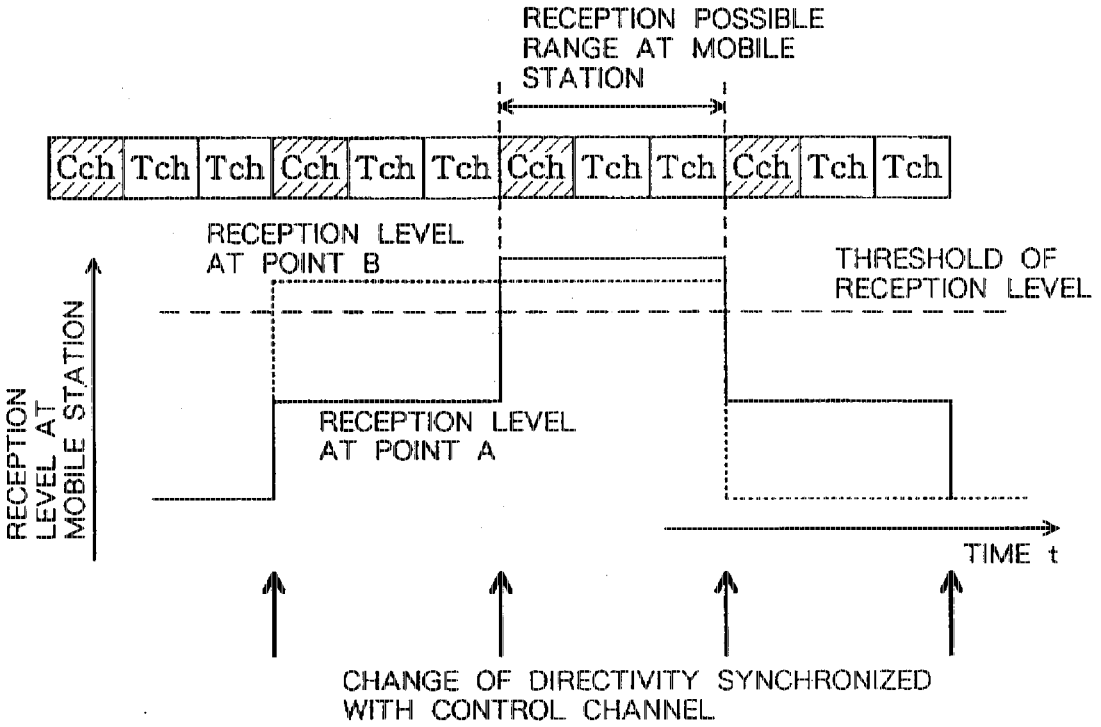
FIG. 10 illustrates the timing relation between signal reception level and forward control channel at a mobile station for a case in which the direction of directivity of the base station antenna is switched synchronous with the control channel.

However, in a case in which the directivity pattern of the base station antenna is changed in steps, by synchronizing the control channel timing with the timing of rotation of the directivity pattern of the base station antenna, the time during which signal reception level exceeds the threshold value can be made shorter than for a case in which the directivity pattern is rotated continuously, and the speed of rotation of the directivity pattern can be increased. FIG. 10 shows the relative timing of signal reception level and forward control channels at a mobile station for a case in which the control channel timing is thus synchronized with the stepped changes in the directivity pattern of the base station antenna.

In this case, the directivity pattern of the base station antenna is rotated in steps such that the time from the beginning of the first slot to the beginning of the second slot of two continuous slots on the control channel equals the time that the signal reception level exceeds the threshold level. Here, the beam direction switches at the beginning time points of control channel slots. When conducted in this way, for a mobile station at point A, reception of a control channel slot begins at the same time the signal reception level exceeds the threshold value, and the next control channel slot begins at the same time the signal reception level falls below the threshold value, as shown in FIG. 10. Accordingly one slot on the control channel can be received at this mobile station. In addition, for a mobile station at point B, reception of a control channel slot begins at the same time the signal reception level exceeds the threshold value, and the third slot on the control channel begins at the same time the signal reception level falls below the threshold value. Accordingly, two slots on the control channel can be received at this mobile station. For mobile stations at positions other than point A and point B, one slot may be receivable as for point A or two slots may be receivable as for point B according to the intensity of the reception level. FIG. 10 illustrates a base station antenna rotation speed for enabling reception of at least one control channel slot at any mobile station, but to guarantee reception of n continuous control channel slots at a mobile station, the directivity of the base station antenna should obviously be rotated by steps such that the time from the beginning of the first slot until the beginning of the (n+1)th slot of n+1 continuous slots equals the time the antenna directivity is fixed in one direction.

Figure 11:
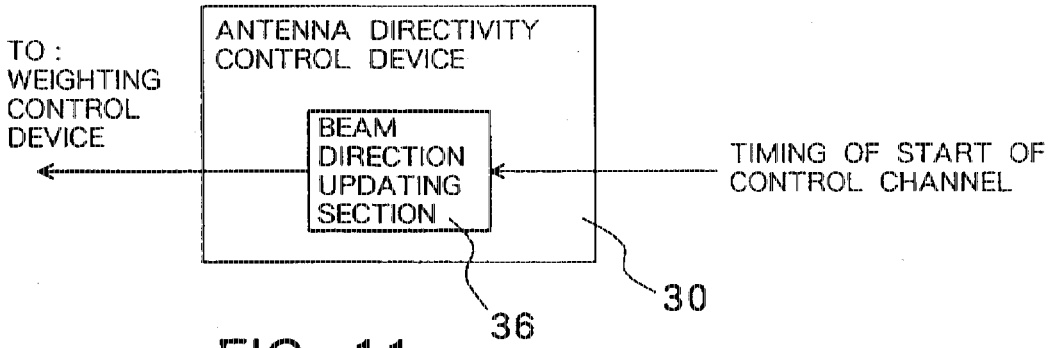
FIG. 11 is a block diagram showing the construction of an antenna directivity control device for a case in which the direction of directivity of the base station antenna is switched synchronous with the control channel.

FIG. 11 is a block diagram showing the construction of antenna directivity control device 30 used in a case in which the directivity pattern is rotated in steps. Antenna directivity control device 30 is equipped only with beam direction updating section 36, and the timing of the start of the control channel is the only input. Upon the input of the timing of the start of the control channel to beam direction updating section 36 for every n slots, the beam direction is rotated a predetermined value ϕ for each updating time (the time of n slots) and beam direction updating section 36 outputs to weighting control device 13.

The foregoing explanation relates to a directivity pattern control method for causing the reception of an arbitrary number of control channel slots at any mobile station during the time that the reception level exceeds the threshold level at the mobile station. Use of the above-described directivity control method guarantees the reception of control channel slots at a particular period. The following explanation relates to a control channel configuration method in which the receivable slots of a control channel have a periodicity.

Figure 12A:
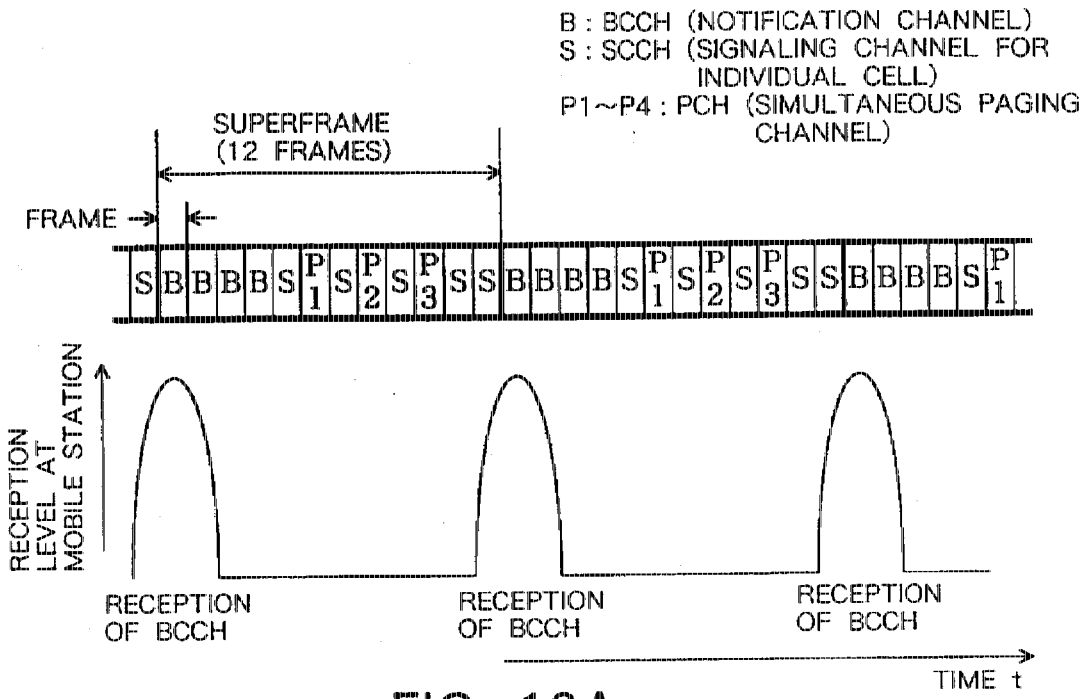
FIGS. 12A and 12B are views illustrating the timing relation between signal reception level and the forward control channel at a mobile station for a case in which the control channel configuration method of the present invention is applied.
Figure 12B:
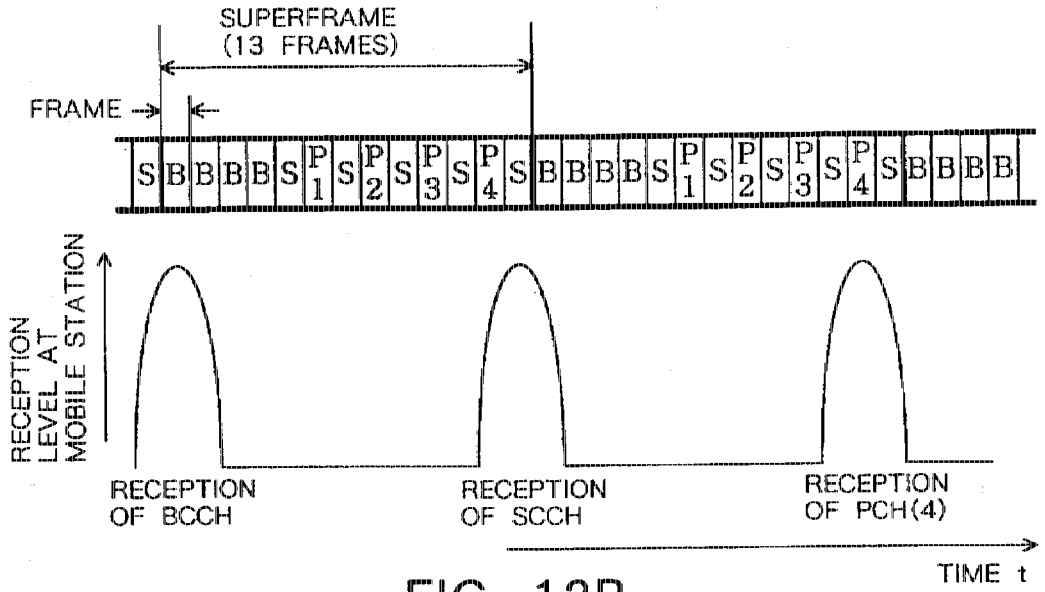

FIGS. 12A and 12B illustrate the timing relation between signal receiving level and forward control channels of a mobile station. Here, forward communication channels time-division-multiplexed together with the control channels for every frame are abbreviated. A forward control channel generally includes a plurality of types having different functions, referred to as notification channels (BCCH: indicated by "B" in the figures), signaling channels (SCCH: indicated by "S" in the figures) for individual cell use, and simultaneous paging channels (PCH, indicated by "P" in the figures). Mobile stations are divided into groups according to their ID numbers and paging is carried out for each group, and the simultaneous paging channel is therefore further divided into a plurality of types (indicated "P1–P4" in the figures).

In the example shown in FIG. 12A, the period of repetition of the control channel (referred to as a "superframe") is 12 frames. In addition, the period of the control channel that can be received by the mobile station is also 12 frames. If the period of repetition of the control channel thus matches the period of the control channels receivable by the mobile stations, the same type of control channel (in the figure, BCCH) is always received at the mobile station and the other types of control channels cannot be received. In this case, the paging or communication channel assignments cannot be received.

To enable a mobile station to receive all types of control channels, the period of repetition of control channels should bear a relatively prime relation to the period of control channels receivable by the mobile station. In the example shown in FIG. 12B, the period of repetition of the control channel (referred to as the "superframe") is 13 frames. The frame number of the received control channel thus progressively decreases by one, thereby enabling reception of all types of control channels.

The present embodiment according to the foregoing explanation applies to a forward control channel, but the same control-channel antenna directivity control device and control channel configuration method may also be applied for a reverse control channel. Finally, the present invention is not limited to application to control channels, and the antenna directivity control method and channel configuration method of the present invention may be applied for communication channels.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. An antenna directivity control method in a mobile communication system that includes a base station and mobile stations disposed within radio zones corresponding to said base station which perform radio communication with said base station, and that employs at said base station an antenna having variable direction of directivity; the method being a control method of said direction of directivity comprising:

continuously changing said direction of directivity of said base station antenna such that signal reception level at each mobile station exceeds a prescribed value during a time interval equal to an elapsed time from beginning of a first slot to an end of an (n+1)th slot of any continuous n+1 slots, with n being a natural number, on at least one time-division-multiplexed channel.

2. An antenna directivity control method in a mobile communication system according to claim 1 wherein said direction of directivity changes by rotating in one direction at a uniform speed in a horizontal plane with said base station as center.

3. An antenna directivity control method in a mobile communication system according to claim 2, wherein a rotation speed of the direction of directivity of the base station antenna is set such that a time required for the direction of directivity of the base station antenna to make one revolution is an integral multiple of a period of slots on one channel.

4. A channel configuration method in a mobile communication system applying the antenna directivity control method described in claim 3, wherein a period of a channel received by a mobile station has a relatively prime relation with respect to a period of multiplexed slots having same function on said channel.

5. An antenna directivity control method in a mobile communication system that includes a base station and mobile stations disposed within radio zones corresponding to said base station which perform radio communication with said base station, and that employs at said base station an antenna having variable direction of directivity within a horizontal plane; the method being a control method of said direction of directivity comprising:

selecting as a standard a mobile station disposed within said radio zones and having worst reception condition, determining rotation angular speed of the direction of directivity within said horizontal plane such that signal reception level at the mobile station as the standard exceeds a prescribed value during a time interval equal to an elapsed time from beginning of a first slot to an end of an (n+1)th slot of any continuous n+1 slots, n being a natural number, on at least one time-division-multiplexed channel.

6. An antenna directivity control method in a mobile communication system according to claim 5 wherein a time required for said direction of directivity to make one revolution in said horizontal plane is an integral multiple of a period of slots on one channel.

7. A channel configuration method in a mobile communication system applying the antenna directivity control method described in claim 5 wherein a period of a channel received by a mobile station has a relatively prime relation with respect to a period of repetition of multiplexed slots having same function on said channel.

8. An antenna directivity control method in a mobile communication system that includes a base station and mobile stations disposed within radio zones corresponding to said base station which perform radio communication with said base station, and that employs at said base station an antenna having variable direction of directivity within a horizontal plane; the method being a control method of said direction of directivity comprising:

changing said direction of directivity of said base station antenna with n continuous slots, n being a natural number, on one time-division-multiplexed channel.

9. A channel configuration method in a mobile communication system applying the antenna directivity control method described in claim 6, wherein a period of a channel received by a mobile station has a relatively prime relation with respect to a period of multiplexed slots having same function on said channel.

* * * * *